US005918573A

United States Patent [19]

Killion

[11] Patent Number: 5,918,573

[45] Date of Patent: Jul. 6, 1999

[54] ENERGY EFFICIENT FLUID PUMP

[76] Inventor: David L. Killion, 8550 Allen Rd., Clarkston, Mich. 48348

[21] Appl. No.: 09/069,807

[22] Filed: Apr. 30, 1998

Related U.S. Application Data

[60] Provisional application No. 60/045,470, May 2, 1997.

[51] Int. Cl.[6] ..... F02B 75/06

[52] U.S. Cl. ..... 123/192.2; 123/196 R; 417/286

[58] Field of Search ..... 123/196 R, 192.2; 417/286, 310, 364

[56] References Cited

U.S. PATENT DOCUMENTS

| | | | |
|---|---|---|---|
| 3,716,308 | 2/1973 | Kobald | 417/286 |
| 3,951,575 | 4/1976 | Motomura . | |
| 4,002,027 | 1/1977 | Eley . | |
| 4,245,964 | 1/1981 | Rannenberg . | |
| 4,306,840 | 12/1981 | Fassbender . | |
| 4,645,026 | 2/1987 | Adams . | |
| 4,703,724 | 11/1987 | Candea . | |
| 4,813,858 | 3/1989 | Eisenbacher . | |
| 4,832,579 | 5/1989 | Norton . | |
| 5,460,211 | 10/1995 | Minati . | |
| 5,464,330 | 11/1995 | Prince . | |
| 5,492,034 | 2/1996 | Bogema . | |
| 5,535,643 | 7/1996 | Garza . | |
| 5,791,309 | 8/1998 | Yamazaki et al. | 123/192.2 |

FOREIGN PATENT DOCUMENTS

| | | | |
|---|---|---|---|
| 904757 | 11/1945 | France | 417/286 |
| 179177 | 8/1991 | Japan | 417/286 |

*Primary Examiner*—Noah P. Kamen

[57] ABSTRACT

A dual pumping element fluid system for an engine or other system which reduces the driving power consumption by unloading one pumping element through the use of recirculation when a fluid pressure target value is achieved. A cross-over port fluid system prevents cavitation of the unloaded pump. A pressure-activated flow control valve mechanism is utilized to open and close the conduits from the secondary pump. The fluid system works in conjunction with an engine balance shaft system to control gear rattle at low speeds without adding undue gear loads at high speeds.

16 Claims, 5 Drawing Sheets

ENERGY EFFICIENT FLUID PUMP

This application claims benefit of Provisional Application No. 60/045,470 filed May 2, 1997.

TECHNICAL FIELD

The present invention relates to a fluid pump system for an engine or other system. More specifically, the present invention relates to a dual pumping element system which allows for the reduction of driving power consumption by effectively switching one pump element out of the system when the engine is operating above a pre-determined fluid pressure.

BACKGROUND OF THE INVENTION

Fluid pump systems, and specifically oil pump systems, are well known in the art. In a typical oil pump system, the oil pump is driven by an engine's crankshaft and is either located on the front of the engine or in the oil pan. Because the oil pump is driven by the crankshaft, it runs at a fixed speed ratio to the engine crankshaft which may result in significant energy loss at higher engine speeds. Moreover, if the oil pump is located on the front of the engine, enough space must be provided to accommodate it.

The use of dual engine balance shafts for certain engines are known in the art to aid in balancing engine vibration and in reducing engine noise. Examples of the use of dual engine balance shafts are disclosed in U.S. Pat. No. 4,703,724 assigned to Chrylser Motors Corporation and U.S. Pat. No. 5,535,643 assigned to General Motors Corporation. In operation, the balance shafts are connected to the engine crankshaft in such a way as to rotate at twice the crankshaft speed. The two balance shafts also rotate in opposite directions to cancel each other's lateral unbalance. The balance shafts counterbalance the vertical shaking forces caused by the acceleration and deceleration of the reciprocating piston assemblies and connection rods.

One problem with the use of balance shafts is that the firing and compression strokes alternately accelerate and decelerate the crankshaft's rotation. These angular accelerations of the crankshaft occur at all engine speeds. However, the "Rigid Body Motion" angular displacements which result are greatest at low speeds, where the capacity for kinetic energy storage (a function of the square of velocity) by the engine's rotating inertia is low, and the time durations of the acceleration phases are high.

This Rigid Body Motion which is greatest at low speed engine operation can create gear rattle by alternately speeding up and slowing down the input shaft of the two counter-rotating balance shafts. The meshing clearance or backlash between the teeth of the two gears opens and then closes noisily, while the balance shafts attempt to maintain constant rotational speed by virtue of their inertia.

In an effort to reduce these vibrational and noise problems, coupling a single oil pump to an engine balance shaft is known. However, these efforts have resulted in inefficient systems that utilize more engine power than is necessary causing decreased fuel efficiency. Moreover, because of the increased engine power usage from excess pump flow volume, the engine can generate more noise than is desired as it drives the oil pump.

While it is known from general pumping technology to interconnect two or more pumps by a fluid control valve, the cost-effective utilization of a low speed supplemental pump to control the low speed problem of gear rattle in a twin balance shaft system is not. Examples of such general pumping technology are shown in U.S. Pat. Nos. 4,306,840, 4,245,964, and 4,832,579.

SUMMARY OF THE INVENTION

It is an object of the present invention to provide a dual pump fluid pumping system that reduces noise while increasing the efficiency of the pump system.

It is another object of the present invention to provide a positive displacement pump system that is drivingly connected to an engine's balance shafts to provide an engine with increased fuel economy.

It is still another object of the present invention to utilize a secondary positive displacement pump that can be effectively switched out of the system to minimize drag torque at higher speeds where the gear rattle tendency diminishes and ceases to become a noise issue.

It is a related object of the present invention to provide a fluid control valve to regulate the flow of fluid to a system depending upon the sensed pressure which results in minimum complexity and cost of the flow control system.

It is a still further object of the present invention to connect a positive displacement pump to the balance shafts to provide a steady torque load on the gears sufficient to prevent unloading of the tooth mesh at low speed and thus minimizing noise during meshing of the gears.

In accordance with the objects of the present invention, a dual pumping system is provided. An illustrative dual pumping system includes an engine having a pair of engine balance shafts. The engine balance shaft is drivingly connected to a primary positive displacement pump which operates whenever the engine is running. The secondary positive displacement pump is connected to a second engine balance shaft. The secondary positive displacement pump supplies its full output flow to the engine only at low engine speeds. The primary positive displacement pump and the secondary positive displacement pump are interconnected by a fluid control valve that operates to divert the fluid flow from the secondary positive displacement pump away from the engine when the oil pressure in the engine reaches a predetermined level. This begins to occur when the pressure of the fluid reaches a threshold level at which the fluid control valve is forced to move to a position where it initiates the opening of a recirculation conduit. When the pressure increases to a higher level, above that of the threshold level, the output from the secondary positive displacement pump is completely diverted from the engine and recirculated back to its own intake. In order to prevent cavitation of the secondary positive displacement pump during recirculation, a small supply of fluid is passed from the outlet of the primary positive displacement pump to the inlet of the secondary positive displacement pump through a cross-over port. Also, a relief valve is available in the output line of the primary positive displacement pump connected to the engine that allows excess volume to return to the sump while maintaining pressure.

These and other features and advantages of the present invention will become apparent from the following description of the invention, when viewed in accordance with the accompanying drawings and appended claims.

BEST MODE(s) FOR CARRYING OUT THE INVENTION

Figure 1:
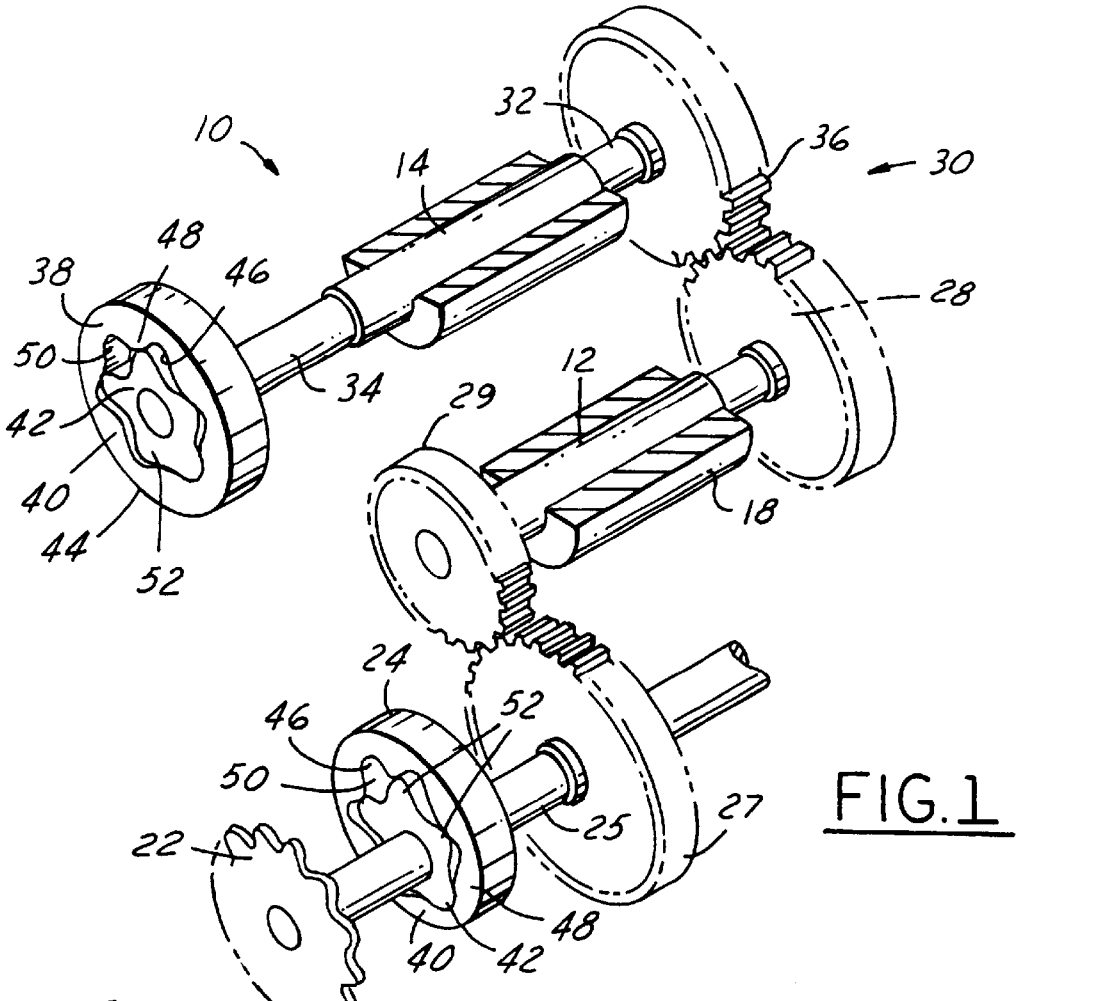
FIG. 1 is a perspective view of an energy efficient oil pump system in accordance with a preferred embodiment of the present invention.

Preferred embodiments of the present invention are shown in the drawings. Referring now to FIGS. 1 through 6, a preferred embodiment of an oil pump system 10, in accordance with the present invention, is disclosed. The present invention is not limited to an oil pump system and may be utilized in any fluid pumping system with a variety of other fluids. The following description of an oil pump system is merely illustrative and will be understood as such by one of skill in the art.

The type of oil pump used with the present invention is preferably a positive displacement oil pump. Pumps of this type include internal tip-sealing rotors, hereafter referred to as "geroter" pumps, vane pumps, gear pumps, and piston pumps. For purposes of illustrating the present application, a geroter-type pump will be utilized which also constitutes the preferred form of the invention. However, it is to be understood that any pump can be utilized and that the depiction of a geroter pump is simply illustrative. Hereinafter, this element will be referred to simply by the term "pump".

The oil pump system 10 is part of a vehicle engine (not shown). The oil pump system 10 includes a balance shaft system preferably located in the oil sump below the engine. The balance shaft system includes a pair of twin counter-rotating balance shafts 12 and 14 which help counteract the secondary shaking forces of an inline four cylinder internal combustion piston engine.

The pair of twin counter-rotating balance shafts comprises a primary balance shaft 12 and a secondary balance shaft 14. The primary balance shaft 12 is the driving shaft, while the secondary balance shaft 14 is the slave or driven balance shaft. The primary balance shaft 12 has an input end 16 and an output end 18. It will be understood that the orientation of the ends 16,18 in the figures is merely for purposes of illustration. The input ends 16,18 can be reversed or differently configured in accordance with the present invention. The input end 16 of the primary balance shaft 12 is connected to and driven by the engine crankshaft 20 through a sprocket or gear 22 and a speed-increasing gear set 27,29. The primary balance shaft 12 has at least one gear 28 of a shaft coupling gear set 30 mounted at the output end 18 of the primary balance shaft 12. By this arrangement, the crankshaft 20 drives the primary shaft 12 at a 2:1 relationship.

The secondary shaft 14 also has an input end 32 and an output end 34. The input end 32 of the secondary shaft 14 has another gear 36, of the shaft coupling gear set 30, mounted thereon. The output end 18 of the primary shaft 12 thus communicates with the input end 32 of the secondary shaft 14 through the shaft coupling gear set 30 with gear 28 being in a meshing relationship with gear 36 so that the primary shaft 12 drives the secondary shaft 14. The shaft coupling gear set 30 maintains an angular relationship between the primary shaft 12 and the secondary shaft 14. The shaft coupling gear set 30, including gears 28 and 36, are shown illustratively as located at one end of the shafts 12 and 14. The shaft coupling gear set 30 can obviously be located anywhere along the length of the primary shaft 12 and secondary shaft 14.

The primary shaft 12 is in communication with a primary pump 24. The primary pump 24 is preferably mounted on an intermediate shaft 25. The intermediate shaft 25 has a gear 27 mounted thereon which communicates with a gear 29 mounted on the primary balance shaft 12. This arrangement reduces the speed for cavitation avoidance of the primary pump 24 and reduces system noise. It should be understood that the primary pump 24 can be located in a variety of other locations in the system, including on the primary shaft 12, on the crankshaft, or on the secondary shaft 14. Mounting of the primary pump 24 on the intermediate shaft 25 is merely illustrative. The secondary shaft 14 has a secondary pump 38 mounted thereon. The oil pumps described herein are preferably gerotor oil pumps which are well known in the art. However, it is within the spirit and scope of the present invention that any commercially available oil pumps may be utilized.

Each of the pumps 24 and 38 comprises an outer ring 40 and a rotor 42. The outer ring 40 has a generally circular outer periphery 44, a hollow center area 46, and an inner periphery 48 with a plurality of pockets 50 formed therein. The rotor 42 is positioned in the hollow center area 46 of the outer ring 40 and has a plurality of teeth 52 that mate with the pockets 50 as the pumps 24, 38 operate.

As is discussed in more detail below in connection with FIGS. 2 through 6, the primary pump 24 operates to pump oil to the engine at all times when the engine is running. On the other hand, the secondary pump 38 operates for this purpose only when the oil pressure is below a predetermined target which generally occurs at lower engine speeds. Thus, at engine speeds below that at which a predetermined oil pressure target is reached, both the primary pump 24 and the secondary pump 38 work in parallel and feed into the same supply outlet to supply the requisite oil flow for the engine. At engine speeds above that at which the initial oil pressure target is reached, one of the two pumps becomes progressively disabled from further contribution to the oil flow volume.

In one preferred embodiment, the secondary pump 38 is disabled from pumping oil to the engine by recirculating its output back to its inlet, which minimizes power consumption by minimizing the pressure differential across the pump. The switching function of the secondary pump 38 is performed by a pressure regulated fluid control valve mechanism 54 which is activated solely by engine oil pressure. This arrangement minimizes the complexity and cost of the fluid control system, and reduces the associated power consumption.

As shown schematically in FIGS. 2 through 6, the primary pump 24 and the secondary pump 38 are interconnected by the fluid control valve mechanism 54 to switch the secondary pump 38 out of the system at a predetermined pressure. The primary pump 24 has an inlet opening 56 and an outlet opening 58 to pump oil from an oil pan or sump 60 to the engine 61. Similarly, the secondary pump has an inlet opening 62 and an outlet opening 64 to pump oil from the oil pan 60 to the engine.

The oil pan 60 accumulates the engine oil for recirculation. A primary oil pickup 66 is located in the oil pan 60 and is in fluid communication with a primary pump inlet passageway 68 to transfer oil from the oil pan 60 to the inlet opening 56 of the primary pump 24. A secondary oil pickup 69 is also in fluid communication with a secondary pump inlet passageway 70 to transfer oil from the oil pan 60 to the secondary pump inlet opening 62 of the secondary pump 38, as required. The outlet opening 58 of the primary pump 24 is in fluid communication with the engine 61 via a primary outlet passageway 72. The outlet opening 58 of the primary pump 24 is also in fluid communication with the fluid control valve mechanism 54 by a valve inlet passage 74. Similarly, the outlet opening 64 of the secondary pump 38 is in fluid communication with the engine via a secondary outlet passageway 76. In an alternative embodiment, only one oil pickup is included which splits into two separate passages with one branch feeding the primary pump inlet opening 56 the other branch feeding and the secondary pump inlet opening 62.

The fluid control valve mechanism 54 comprises a movable valve or piston member 78 which is sealingly positioned in a valve housing 80. The movable valve member 78 is preferably moveable from an open position, shown in FIG. 2 to a closed position, shown in FIG. 6. The valve mechanism 54 further includes a biasing spring 82 which biases the moveable valve member 78 into the open position. The movable valve member 78 is preferably a three-chambered spool valve and comprising a first end 84 that is in communication with the fluid control valve inlet passage 74, a first plunger portion 86, a second plunger portion 87, and a second end 88 that is in communication with the biasing spring 82. The biasing spring 82 is attached within the valve housing 80 at a fixed spring attachment point 90 and exerts force on the second end 88 of the movable valve member 78. The arrangement of the valve member 78 is that of a "spool valve", which allows the pressure of the secondary pump to act equally on the opposing internal faces of the plunger portions that define the fluid passageway. This avoids unwanted biasing of the valve plungers to provide for consistency of valve response to engine oil pressure. Alternative valve member arrangements may be employed. The movable valve member is also preferably a three function valve.

Figure 2:
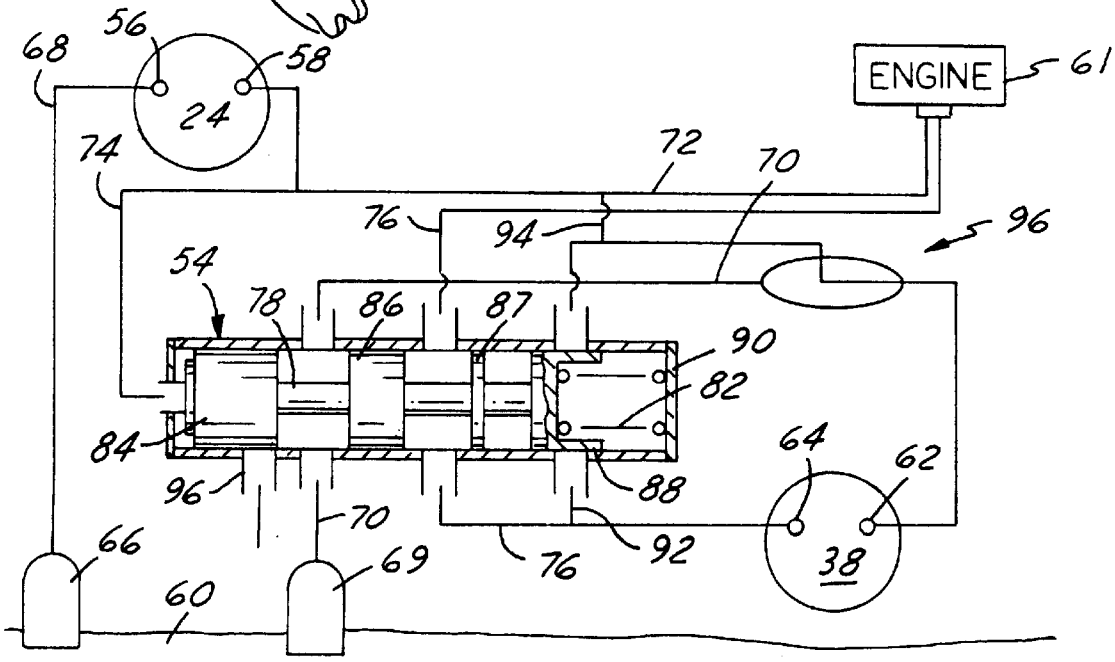
FIG. 2 is a schematic illustration of a fluid control valve in an initial position and a flow circuit in accordance with the present invention when the pressure is below the threshold pressure.

In the configuration shown in FIG. 2, both the primary pump 24 and the secondary pump 38 receive oil from the oil sump 60 through passageways 68 and 70, respectively. Both the primary pump 24 and the secondary pump 38 draw oil into their respective input openings 56 and 62 and discharge oil from their respective outlet openings 58 and 64 through respective passageways 72 and 76 to the engine 61. In this configuration, the pumps operate at lower speeds and thus, the pressure in the engine is below the pressure threshold necessary to cause the movable valve member 78 to shift.

Figure 3:
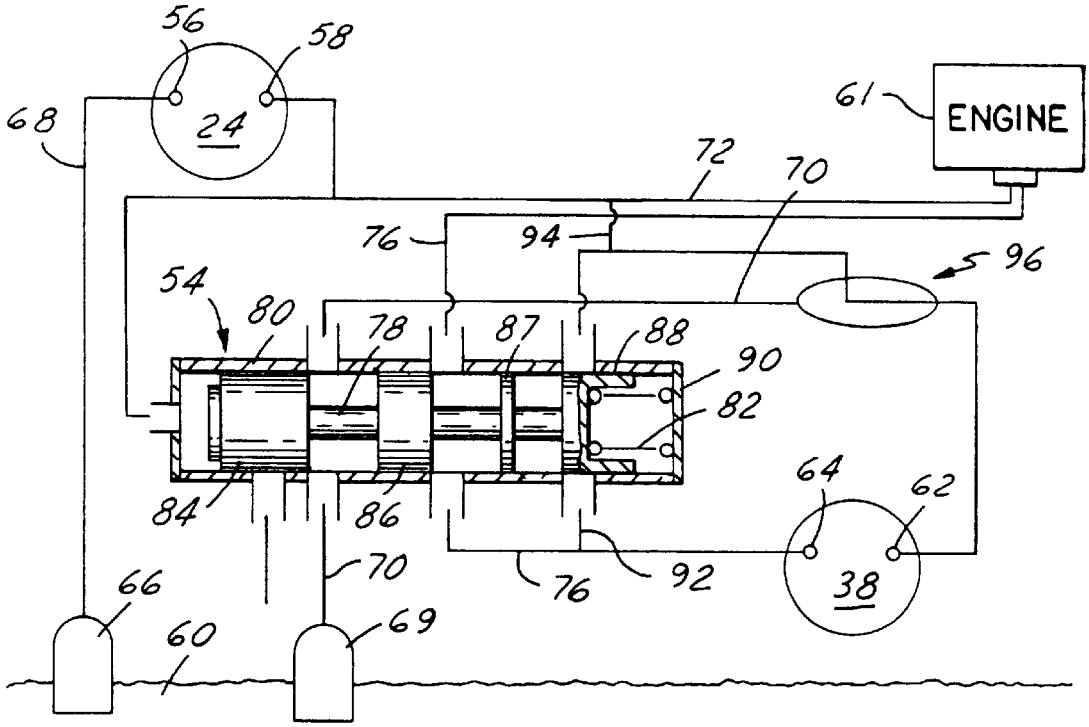
FIG. 3 is schematic illustration of a flow circuit for a preferred embodiment of the fluid control valve in a second position, when the pressure has just reached the threshold pressure.

FIG. 3 schematically illustrates the oil pump system 10 in accordance with the present invention when the pressure in the engine has reached a predetermined pressure threshold level. As shown in FIG. 3, the movable valve member 78 has shifted away from its initial position (FIG. 2) towards its fifth position (FIG. 6) at the end of its range of travel. The oil pressure from the engine has reached a level that the oil pressure present in passage 74 acting on the first end 84 of the movable valve member 78 causes the movable valve member 78 to begin to overcome the biasing force of the spring 82, and thus move the valve member 78 to its second position, but both pumps are continuing to contribute their outputs in parallel so as to provide pressurized oil flow to the engine's bearings and other components.

Figure 4:
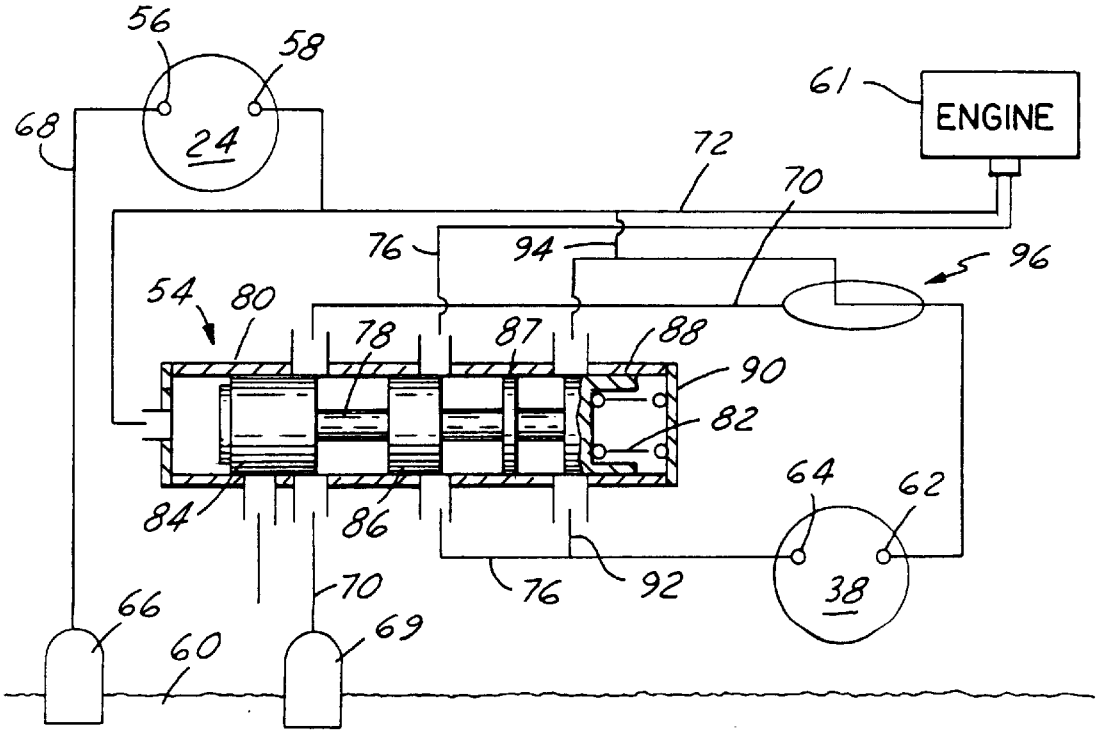
FIG. 4 is a schematic illustration of a flow circuit for a preferred embodiment of the fluid control valve in a third position where the fluid control valve has started to close off both the oil input to the secondary positive displacement pump and the oil output to the engine from the secondary positive displacement pump, while partially opening the recirculation conduit of the secondary pump.

In FIG. 4, under increased oil pressure, the movable valve member 78 has moved to its third position where its first end 84 begins to close off the flow of oil from the oil sump 60 through the secondary pump inlet passage 70 to the secondary pump inlet opening 62. Additionally, the center section 86 of the valve member 78 begins to close off the flow of oil from the secondary pump outlet opening 64 through the secondary pump outlet passage 76 to the engine and the second end 88 of the valve member 78 begins to open the recirculation passage 92 to the secondary pump inlet 62.

Figure 5:
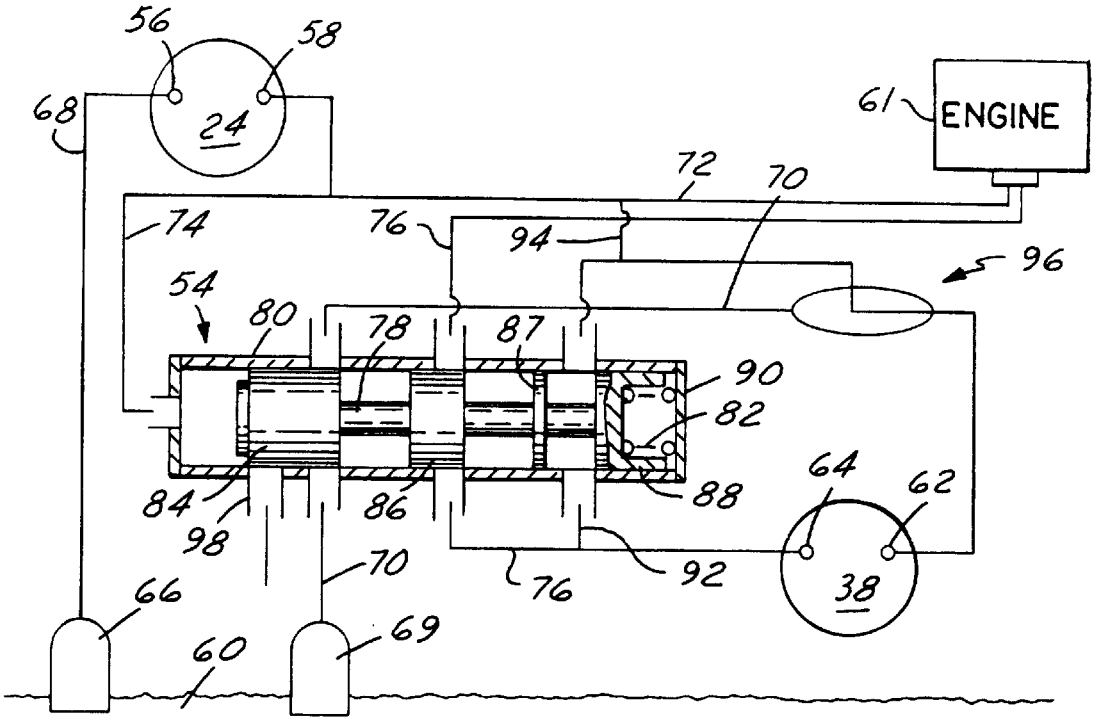
FIG. 5 is a schematic illustration of a flow circuit for a preferred embodiment of the fluid control valve in a fourth position with the input of oil to the secondary positive displacement pump and output of oil to the engine from the secondary positive displacement pump completely shut-off, while the recirculation conduit of the secondary pump is substantially fully open and the relief valve is about to open.

As shown in FIG. 5, when the pressure in the engine exceeds the second pressure threshold, the valve member 78 has moved against the bias of the spring 82 such that the valve member 78 is in its fourth position. The first end 84 of the valve member 78 completely blocks the flow of oil through the secondary pump input passage 70 to the secondary pump input opening 62. At the same time, the center section 86 of the valve member 78 also completely blocks the flow of oil through the secondary pump outlet passage 76 to the engine 61 and the second end 88 fully opens the recirculation passage 92 to the secondary pump 38.

In the arrangement shown in FIG. 5, the primary pump 24 is the only pump providing oil to the engine. The oil is provided through the primary pump outlet passage 72. The engine is thus running at a higher speed and the power consumption is reduced under these conditions by preventing additional supply of oil from the secondary pump 38. In this arrangement, the secondary pump 38 flow has effectively been switched out of the system 10.

Whenever the movable valve member 78 blocks off the secondary pump outlet passage 76, it also opens a recirculation passage 92. The recirculation passage 92 connects the secondary pump outlet opening 64 directly to the secondary pump inlet opening 62. The secondary pump 38 thus continues to pump oil (the oil is recirculated back to the secondary pump 38 via passage 92), even though the secondary pump inlet passage 70 is closed preventing the egress of oil from the oil sump 60 to the secondary pump 38.

The high speed recirculation passage 92 is also provided with a cross-over conduit 94. The cross-over port 94 connects the primary pump outlet passage 72 to the high speed recirculation passage 92. The cross-over port 94 prevents oil cavitation in the secondary pump 38 at high speed by continuously supplying engine oil pressure to the conduit pump's recirculation circuit. The cross-over conduit 94 also ensures oil supply to the secondary pump to make up for any leakage losses, whether natural or deliberate as required to prevent overheating. The cross-over conduit 94 is preferably sized to prevent excess flow volume from leaking from the primary pump outlet passage 72 to the secondary pump inlet passage 70 during low speed sub-bypass pressure operation. This is important, as otherwise, excess oil flow would waste oil from the discharge flow of the primary pump 24 and needlessly pressurize the secondary pump inlet passage 70, tending to reduce oil uptake from the oil sump 60.

Additionally, in the preferred embodiment, a jet pump 96 is included. A jet pump is a configuration in which the main flow velocity is used to create a drop in pressure around it, thus pulling more fluid into the stream from the sides. In this case, the center stream from the secondary pump is directed so its flow serves to pull oil from the common intake into its flow from the sides and keep the intake flow back to the secondary pump fully supplied. In the preferred embodiment of the present invention, the jet pump 96 is formed by the union of the secondary pump inlet passage 70 and the recirculation passage 92. The secondary pump inlet passage 70 is arrayed circumferentially around the center stream, as is well-known in the art.

It will be understood by one of ordinary skill in the art, that other jet pump configurations may also be incorporated in accordance with the present invention. For example, the passageway 70 can join with the inlet from the recirculation passage 92 to form the jet pump 96. The jet pump 96 minimizes or eliminates any backflow of oil from the high speed recirculation passage 92 to the secondary pump inlet passage 70 during sub-bypass pressure transitional valving phases when both low speed volume supply and high speed recirculation circuits are partially open, such as shown in FIG. 4. The flow of oil in the recirculation passage 92 acts as a jet to maintain a constant flow of oil to the secondary pump inlet opening 62.

Figure 6:
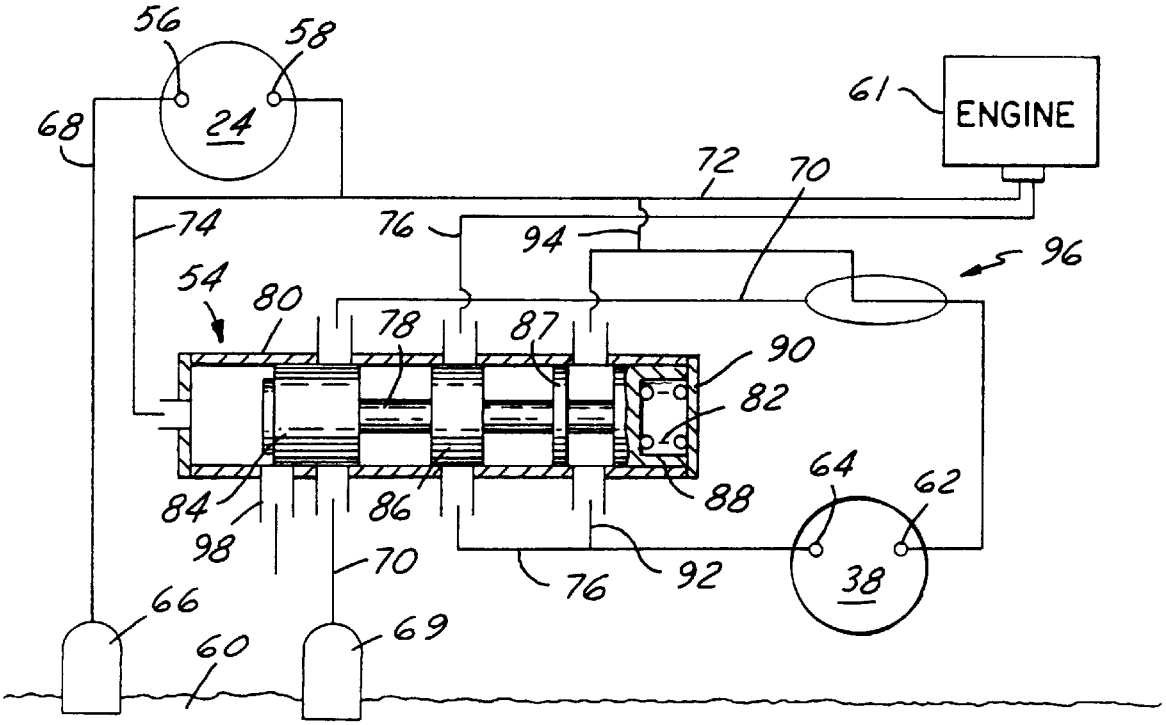
FIG. 6 is a schematic illustration of a flow circuit for a preferred embodiment of the fluid control valve with the valve in a fifth position with the relief valve for the primary positive displacement pump in the open position.

FIG. 6 illustrates the movable valve member 78 in its fifth position. The secondary pump 38 is effectively shut-out of the system as a result of the valve member 78 shutting off the flow of oil from the oil sump 60 through secondary pump inlet passage 70 to the secondary pump inlet opening 62 and also shutting off the flow of oil to the engine through secondary gerotor outlet passage 76. The oil is instead redirected from the secondary pump outlet opening 64 to the secondary pump inlet opening 62 through recirculation passage 92. In this fully closed position, a relief port 98 is exposed which allows excess oil generated by the primary pump 24 at high speeds to be passed back to the oil sump 60. When the pressure in the engine decreases, the valve member 78 will return toward its fully open position, adding back the portion of the secondary pump oil flow volume that is required to maintain oil pressure as appropriate to the engine's RPM.

Figure 7:
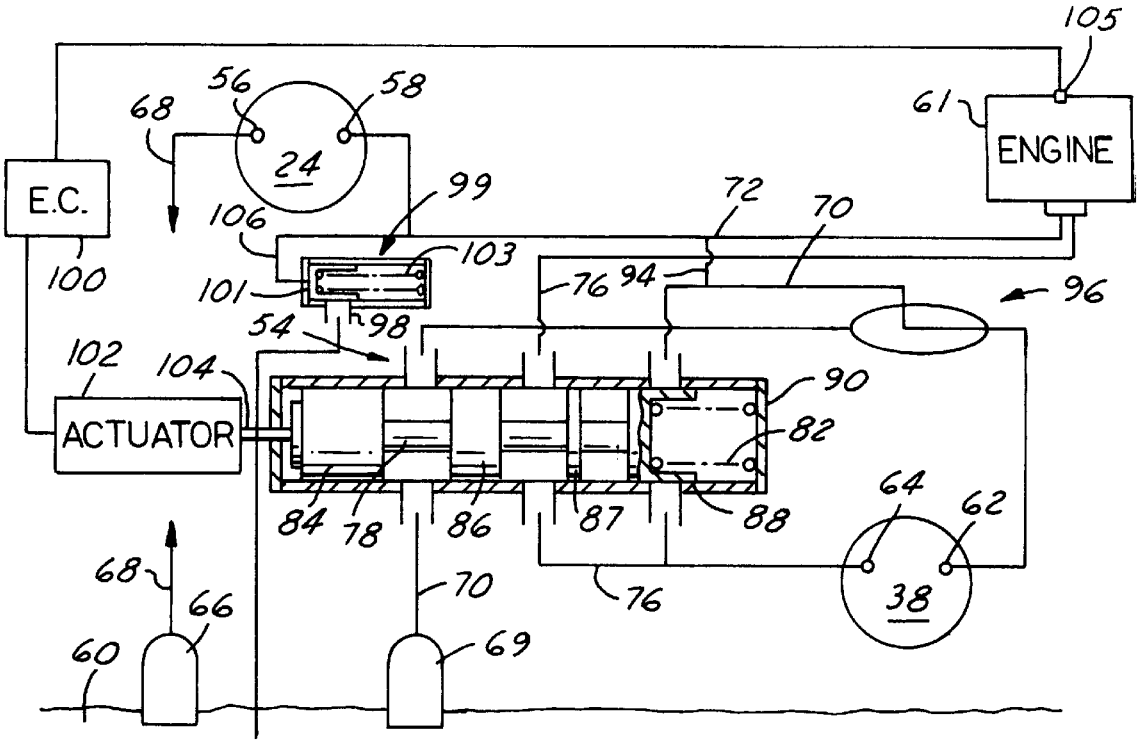
FIG. 7 is a schematic illustration of a flow circuit for an alternative preferred embodiment utilizing an electronically controlled fluid control valve in accordance with the present invention.

FIG. 7 illustrates an alternative preferred embodiment, in accordance with the present invention, wherein the flow control valve 54 illustrated in FIGS. 2 through 6 is hydraulically operated. Alternatively, as shown schematically in the embodiment of FIG. 7, the flow control valve 54 can be electronically controlled by a controller 100 which is operatively connected to an actuator 102. The actuator 102 can be any commercially available or well-known actuating device such as a piston, a gear, an armature or the like.

The actuator 102 has a reciprocating element 104 that contacts the valve member 78. The reciprocating element 104 moves back and forth in response to signals from the controller 100, as sensed by a pressure sensor 105 in the engine 61, to move the flow control valve 54 as required to divert the flow through the appropriate passages to the necessary locations in the system. The corresponding flow scheme, is in accordance with that described herein above. To the extent the passages are the same, they will not be redescribed.

Because the flow control valve 54 is electronically controlled, the fluid flow control valve 54 does not need any oil flow thereto in order to cause the valve to move. Accordingly, this embodiment does not incorporate a fluid flow valve inlet passageway 74. The flow of fluid from the primary pump outlet opening 58 flows directly through primary pump outlet passageway 72 to the engine 61. Because there is no fluid flow into the valve housing 80, the relief port 98 is not in communication with the valve housing. Instead, the relief port 98 is in communication with the primary pump outlet passage 72. The relief port 98 provides the same function of removing excess fluid from the system 10 and delivering it to the oil sump 60. A relief valve 99, having a piston 101 and a spring 103, is in fluid communication with the primary pump outlet opening 58 via passageway 106. When the oil pressure in passageway 72 becomes great enough, it will move the piston 101 against the force of the spring 103 to expose the relief port 98 allowing fluid to drain to the sump 60.

The valve 54 shown in FIG. 7 operates in a similar fashion as the prior embodiment in that the valve member 78 is moved by the actuator 102 away from its initial position when the pressure in the engine reaches a pre-determined threshold. The actuator 102 continues to move the valve member 78 against the force of the biasing spring 82 as the pressure in the engine increases until the flow to the secondary pump inlet 62 through passageway 70 is shut off and the recirculation circuit 92 is opened, thus short circuiting the secondary pump 38 from the system. A two-way actuator may be substituted for the actuator 102 which would alleviate the need for the biasing spring 82.

The action of the drag torque or power consumption of the secondary gerotor pump 38 on the secondary balance shaft 14 in all of the embodiments of the invention slows down the secondary balance shaft 14, as the primary balance shaft 12 slows down. This action reduces the rotational speed of the balance shaft 12 as its upstream drive components slow down, thus inhibiting opening, as well as subsequent noisy closing, of the gear mesh clearance, or backlash space, with relative motion between the drive components.

A benefit of utilizing the secondary gerotor oil pump in the manner described above, is that its drag torque is minimized at higher speeds where the gear rattle tendency diminishes and ceases to be a noise issue. This eliminates the cost of needless power capacity of gearsets, and gear noise due to unnecessarily higher gear tooth loadings.

Figure 8:
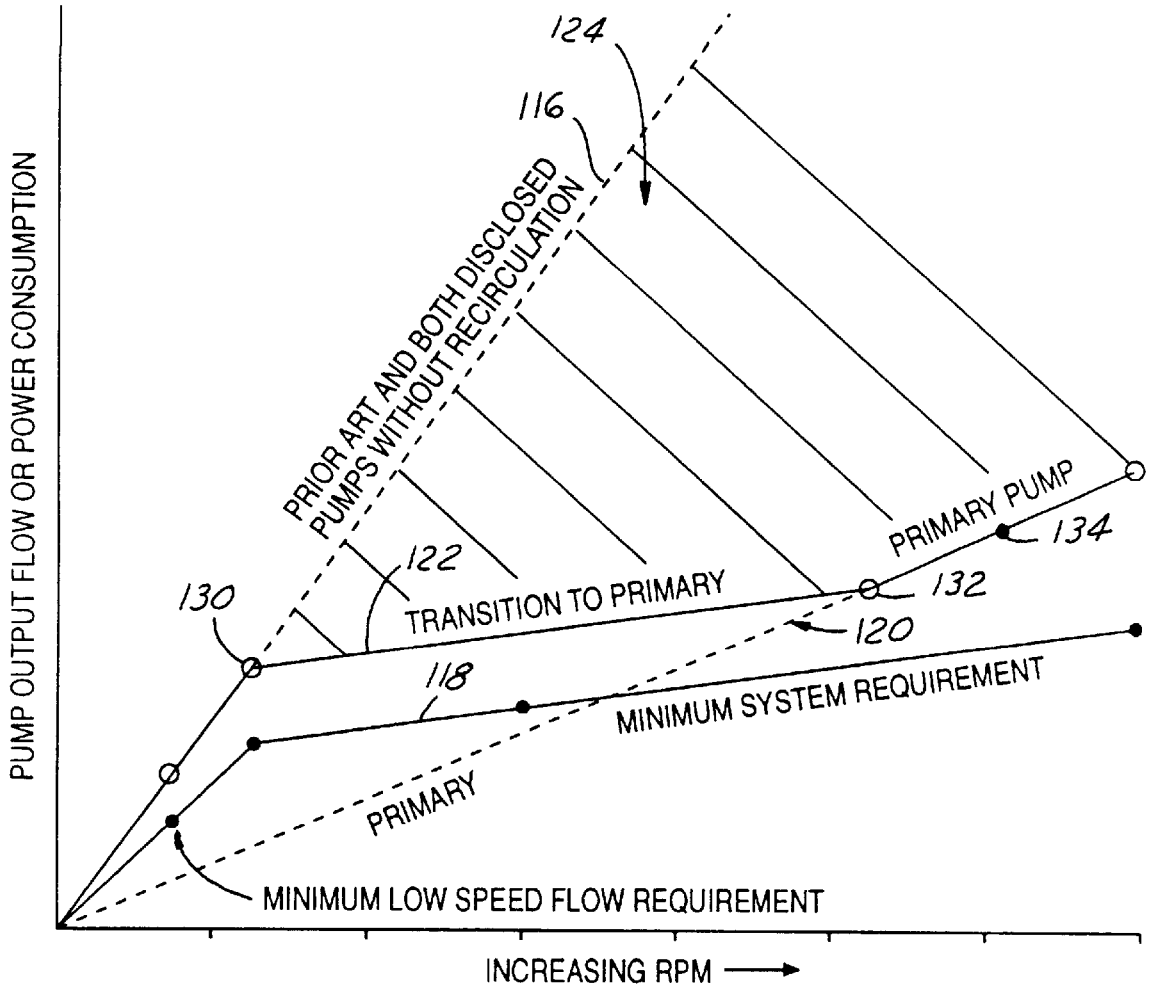
FIG. 8 is a graph charting the volume of fluid pumped versus engine speed for a prior art pump and an energy efficient pump in accordance with the present invention.

FIG. 8 is a graph illustrating an engine pump outlet flow or power consumption versus engine speed in revolutions per minute (RPM) . The line 116 represents engine speed versus pump output flow for a prior art pump, as well as the combined output of the two pumps of the present invention without short circuiting of the secondary pump. The line 118 is the minimum engine requirements for an engine in accordance with the present invention. The line 120 represents the RPM versus pump output flow for the primary pump which is operating at all speeds. The line 122 represents the transition section where the secondary pump output is reduced to the point of where only the primary pump is providing oil to the engine. Thus, in accordance with the present invention, the power consumption of the system 10 is represented by line 116 up until point 130. Point 130 corresponds to the valve position shown in FIG. 3 where the valve member 78 has just begun to move from its initial position. As the engine speed increases, the power consumption of the system is represented by line 122 which is the transition from where both pumps work together to where only the primary pump is providing fluid to the load. After point 132, which corresponds to the valve position shown in FIG. 5, the power consumption of the system 10, with the secondary pump 38 short circuited, is illustrated by line 134.

As shown by the graph, the minimum engine requirements 118 are higher at low RPMs than the flow provided by the primary pump as illustrated by line 120. The prior art pumps represented by line 116 provide sufficient flow volume, but require much larger power consumption than is necessary. Thus, as the engine speed increases with the prior pumps, the amount of power increases and the area 124 between line 116 and 122 represents the amount of energy saved by usage of the present invention.

Having now fully described the invention, it will be apparent to one of ordinary skill in the art that many changes and modifications can be made thereto without departing from the spirit or scope of the invention as set forth herein.

What is claimed is:

1. A dual pumping element fluid pump system comprising:

a primary pump element having an intake port that receives fluid from a fluid supply and a discharge port;

a secondary pump element discreet from said primary pump element and having an intake port that receives fluid from a fluid supply and a discharge port;

a fluid flow control valve that is in fluid communication with said primary pump element and said secondary pump element and movable between a normally open position and a closed position;

a recirculation conduit that connects said secondary pump element discharge port with said secondary pump element intake port;

wherein when said system is operating at low speeds, said fluid control valve is in said normally open position and said system is provided with fluid from said primary pump element discharge port and said secondary pump element discharge port; and wherein when said system is operating at high speeds, said fluid flow control valve is moved to said closed position directing said fluid from said secondary pump element discharge port through said recirculation conduit to said secondary pump element intake port, said valve also closing off said flow of fluid from said fluid supply to said secondary pump element intake port.

2. The system of claim 1 further comprising:

a cross-over conduit connecting said primary pump element discharge port to said recirculation circuit to prevent cavitation of said secondary pump element.

3. The system of claim 2, wherein said fluid flow control valve is a three function valve assembly which remains in said normally open position until a threshold pressure within the system is reached.

4. The system of claim 3, wherein upon incremental pressure increases above said threshold pressure, said fluid control valve simultaneously opens an incremental area of said recirculation passage while closing off corresponding incremental areas of both said secondary pump element intake port and said secondary pump element discharge port.

5. The system of claim 4, wherein when the system reaches a second threshold pressure, said fluid control valve has fully opened said recirculation passage and prevents said secondary pump element from receiving fluid from said fluid supply and from discharging fluid to the system.

6. The system of claim 5, wherein said primary pump element is mounted on and driven by a driving shaft of an internal combustion piston engine's twin counter-rotating balance shaft system.

7. The system of claim 6, wherein said secondary pump element is mounted on and driven by a slave shaft of said internal combustion piston engine's twin counter-rotating balance shaft system.

8. The system of claim 5, wherein said recirculation passage and the intake passage of said secondary pump element form a jet pump at their union such that the secondary pump element's discharge flow energy is transferred to its intake flow during transitional valving phases, wherein energy is conserved and creation of backflow in said inlet passage is minimized.

9. The system of claim 5, wherein said fluid flow control valve is hydraulically actuated.

10. The system of claim 5, wherein said fluid flow control valve is electronically controlled.

11. The system of claim 5, wherein at least one of said first pump element and said second pump element are of an internal tip sealing rotor type.

12. An engine balancer apparatus within an engine comprising:

a first rotary balance shaft:

a second rotary balance shaft;

means for drivingly connecting the balance shafts to a crankshaft of an engine for rotation in a predetermined speed relationship with the crankshaft;

a first fluid pump in communication with a driving shaft having a fluid inlet that communicates with a fluid reservoir and an outlet that communicates with a load;

a second fluid pump driven by said second rotary balance shaft, said second fluid pump having a fluid inlet that communicates with a fluid reservoir and an outlet that communicates with a load;

a flow control valve interconnecting said first and second pumps;

whereby when the pressure in the engine is below a predetermined threshold, said flow control valve operates to enable both said first and second pumps to supply the load;

whereby when the pressure in the engine reaches said predetermined threshold, said flow control valve starts to close said second pump inlet and outlet and starts to open a short circuit conduit so that fluid recirculates within said short circuit conduit and is prevented from supplying the load; and whereby when the pressure in the engine is above said predetermined threshold, said valve fully closes said inlet and outlet of said second pump and said short circuit conduit is fully opened.

13. The engine balancer apparatus of claim 12 wherein at least one of said first and second fluid pumps are of the internal tip sealing rotor type.

14. The engine balancer apparatus of claim 12, wherein a cross-over conduit connects said short circuit conduit with said outlet of said first fluid pump to prevent cavitation of said second pump.

15. The engine balancer of claim 12, wherein a jet pump is formed at the union of said inlet of said second pump and said short circuit conduit to minimize backflow of fluid into the inlet passage.

16. A method of pumping fluid to an engine having a fluid supply, comprising:

providing a primary pump element with an intake port and a discharge port;

providing a secondary pump element with an intake port and a discharge port, said secondary pump element being discreet from said primary pump element;

providing a flow control valve that is movable between a normally open position and a closed position;

discharging fluid to the engine through said primary pump element discharge port and said secondary pump element discharge port when the pressure in the engine is below a predetermined threshold;

moving said flow control valve to a partially closed position when the pressure in the engine reaches said predetermined threshold;

moving said flow control valve to said closed position when the pressure in the engine exceeds said predetermined threshold;

and connecting said secondary pump element intake port with said secondary pump element discharge port when said flow control valve is in said closed position, such that the engine is provided with fluid through only said primary pump element discharge port while also closing said flow of fluid to said secondary pump element from the fluid supply.

* * * * *